US005661513A

United States Patent [19]

Shirakawa et al.

[11] Patent Number: 5,661,513

[45] Date of Patent: Aug. 26, 1997

[54] THERMAL HEAD

[75] Inventors: Takashi Shirakawa; Toshifumi Nakatani; Toshiya Endoh, all of Iwate-ken, Japan

[73] Assignee: Alps Electric Co., Ltd., Tokyo, Japan

[21] Appl. No.: 718,680

[22] Filed: Sep. 24, 1996

Related U.S. Application Data

[63] Continuation of Ser. No. 504,508, Jul. 20, 1995, abandoned.

[30] Foreign Application Priority Data

Jul. 29, 1994 [JP] Japan ..... 6-178954

[51] Int. Cl.[6] ..... B41J 2/335

[52] U.S. Cl. ..... 347/202; 347/205; 347/208

[58] Field of Search ..... 347/202, 205, 347/208

[56] References Cited

U.S. PATENT DOCUMENTS 4,963,893 10/1990 Homma et al. ..... 347/202
5,119,112 6/1992 Homma et al. ..... 347/202
5,177,498 1/1993 Homma et al. ..... 347/202
5,473,357 12/1995 Shirakawa et al. ..... 347/202

FOREIGN PATENT DOCUMENTS 6-31959 2/1994 Japan ..... 347/202
6-191073 7/1994 Japan .

*Primary Examiner*—Huan H. Tran
*Attorney, Agent, or Firm*—Guy W. Shoup; Patrick T. Bever

[57] ABSTRACT

To realize a high-quality and high-speed printing which can sufficiently comply with high definition, a thermal head having a high heat resistance and excellent thermal responsivity comprises a high thermal conductivity substrate, a heat accumulating layer formed on the surface of the substrate, a plurality of heater elements formed on the surface of the heat accumulating layer in line, a common electrode and an individual electrode energizing each of the heater elements, and a protective layer formed so as to cover the heat accumulating layer, the heater elements and the electrodes, wherein a stress-resistant layer composed of an insulating high-modulus ceramic is provided on the surface of the heat accumulating layer.

9 Claims, 1 Drawing Sheet

THERMAL HEAD

This application is a continuation of application Ser. No. 08/504,508, filed Jul. 20, 1995, abandoned.

BACKGROUND OF THE INVENTION

1. Field of the Invention

The present invention relates to a thermal head which is mounted on a thermal printer and energized and heated in accordance with printing information to perform a desired printing.

2. Description of the Related Art

In general, a thermal head mounted on a thermal printer includes a plurality of heater elements arranged linearly on one substrate. Such a thermal head is used for performing printing with coloring a heat-sensitive recording paper or with transferring ink to a plain paper through an ink ribbon by selectively energizing and heating each of the heater elements in accordance with desired printing information.

FIG. 3 shows a conventional thermal head. Referring to FIG. 3, a glaze layer 2 composed of glass and the like functioning as a heat accumulating layer is formed on an insulating substrate 1 which is composed of ceramic such as $Al_2O_3$. The top surface of the glaze layer 2 at a portion corresponding to the position of a heating portion is so formed as to have a circular arc sectional configuration. Heater resistive elements composed of $Ta_2N$ and the like are adhered to the surface of the glaze layer 2 by vapor deposition or sputtering. Then, the elements are etched to become a plurality of heater elements 3 responsive to the dot numbers arranged linearly on the top surface of the glaze layer 2. A common electrode 4 to be connected to each of the heater elements 3 is formed on one side of the heater elements 3, and an individual electrode 5 energizing separately each of the heater elements 3 is connected to the other side of the heater elements 3, respectively. These common electrode 4 and individual electrode 5 are composed of Al, Cu or a metal, and adhered to the glaze layer 2 by vapor deposition or sputtering, and then patterned into desired shapes by etching.

Furthermore, a protective layer 6 having a thickness of about 5–10 μm is formed on the surfaces of the heater elements 3, the common electrode 4 and the individual electrode 5 so as to protect the glaze layer 2, heater elements 3, the common electrode 4 and the individual electrode 5. This protective layer 6 covers entire surfaces except terminal portions of the electrodes 4 and 5. The protective layer 6 includes an oxidation-resistant layer 7 having a thickness of about 2 μm composed of $SiO_2$ or the like for protecting the heater elements 3 from deterioration due to oxidation, and a wear resisting layer 8 having a thickness of about 3–8 μm composed of $Ta_2O_5$ or the like for protecting the heater elements 3, the common electrode 4 and the individual electrode 5 laminated in this turn. The oxidation-resistant layer 7 and the wear resisting layer 8 are sequentially formed by vapor deposition or sputtering.

In a thermal transfer printer using the thermal head as described above, a desired printing is performed by selectively energizing and heating the individual electrode 5 of the heater elements 3 based on desired printing signals to fuse the ink of the ink ribbon and transfer to a paper with the thermal head being pressed into contact with the paper through the ink ribbon. In a thermal printer using the thermal head as described above, a desired printing is performed by selectively energizing and heating the individual electrode 5 of the heater elements 3 based on desired printing signals to color the heat-sensitive recording paper with the thermal head being directly pressed into contact with the paper carried onto a platen.

In such a thermal head as described above, by a combination of the glaze layer 2 of low thermal conductivity and the substrate 1 of high thermal conductivity composed of $Al_2O_3$, electric power efficiency and printing properties are balanced utilizing heat accumulating effect of Joule heat generated at the heater elements 3. In other words, since the time constant for cooling the heater elements 3 is prolonged due to heat accumulating effect of the glaze layer 2, deterioration of printing quality such as tailing, bleeding and margin stain, and dot omission due to overheating of the heater elements 3 will occur. Thus, in consideration of electric power efficiency and printing properties, the thickness of the glaze layer 2 is controlled in accordance with use conditions thereof. Usually, the thickness of the glaze layer 2 is about 30–60 μm.

In recent years, with an increasing need for a printer capable of high-quality printing and high-speed printing due to high definition, a thermal printer with printing resolution of 400 dpi and printing speed of 100 cps has become practical. In this thermal printer, energizing is controlled with a very short pulse width such as 300 μs or less of a driving cycle of the heater elements 3. And, high definition and speeding-up of the printing tend to be further advanced.

In such a thermal printer for realizing high definition and high-speed printing, the printing quality is deteriorated by intensive heat accumulation of the thermal head. Thus, the thickness of the glaze layer 2 is reduced to about 30 μm, and energizing time to the heater elements 3 is corrected with electrical means using LSI for correcting heat history so that temperature rise of the thermal head due to heat accumulation is closely controlled.

However, when high definition and speeding-up of the printing speed are further advanced, it is difficult to prevent deterioration of the printing quality due to heat accumulation of the thermal head by only such technique as described above thus, a technique which can thoroughly solve the problem of heat accumulation is demanded.

In a control of energizing at a very short pulse width such as such as 300 μs or less of a driving cycle of the heater elements 3, for obtaining a desired printing quality, the peak temperature of the heater elements 3 of the thermal head must be increased to obtain a predetermined printing energy. For example, when environmental temperature at the time of printing is low such as 5° C., high energy must be applied to the thermal head to perform printing, and the temperature increases together with the influence of the heat accumulation higher than about 700° C. of which the glaze layer 2 and the heater elements 3 can withstand. As a result, the glaze layer 2 is fused or undergoes a thermal deformation, or electrical resistance value of the heater elements 3 is changed so that the thermal head cannot be used for the high-speed printing in a low-temperature environment.

Furthermore, since the heater elements 3 composed of cermet materials such as $Ta\text{-}SiO_2$ and the like has properties such that the sheet resistance value thereof is reduced approximately by half when subjected to a high-temperature vacuum annealing treatment. Thus, although the high-temperature vacuum annealing treatment at a temperature higher than that of the actual use is essential to the heater elements 3, the heater elements 3 cannot be subjected to the high-temperature vacuum annealing treatment because the glaze layer 2 can withstand a low temperature as described above.

In addition, the glaze layer 2 composed of ceramic such as a glass or the like has low elastic modulus. Thus, when the terminals of the individual electrodes are connected to the connecting terminals of FPC by a solder, the glaze layer 2 cannot withstand a thermal stress due to contraction of a solder plating when cooled to be solidified, and a part of the glaze layer 2 is torn off and chipped.

SUMMARY OF THE INVENTION

It is an object of the present invention to provide a thermal head having high heat resistance and good thermal responsivity capable of realizing high-quality and high-speed printing which can sufficiently comply with high definition.

DESCRIPTION OF THE PREFERRED EMBODIMENTS

The preferred embodiment of the thermal head according to the present invention will be described with reference to FIGS. 1 and 2.

Figure 1:
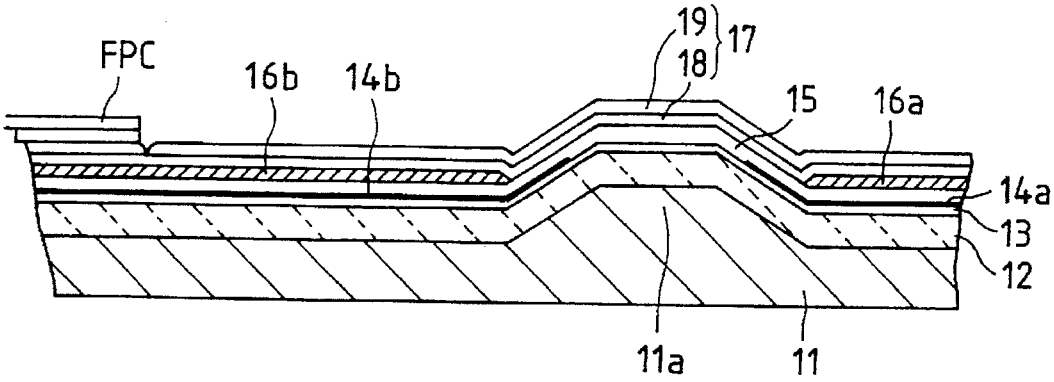
FIG. 1 is a main part cross sectional view showing an embodiment a thermal head according to the present invention.

As shown in FIG. 1, in a thermal head of this embodiment, a protruding portion 11*a* having trapezoidal sectional configuration is formed integrally on a part of the surface of a substrate 11 which is composed of a material having high thermal conductivity such as Si by means of etching and the like. A heat accumulating layer 12 having a thickness of about 15–35 μm and functioning as a protective layer inclusive of the protruding portion 11*a* is formed on the surface of the substrate 11. The heat accumulating layer 12 comprises of a compound including Si, at least one of the transition metals selected from Ta, W, Cr, Mo, Ti, Zr, Nb, Hf, V, Fe, Ni, Co, Cu, Al, Y, La and Ce, and oxygen. In order to allow the heat accumulating layer 12 to have resistance to stress-breaking and etching, a stress-resistant layer 13 composed of a high-modulus ceramic such as $Al_2O_3$, AlN and SiC. A lower common electrode 14*a* and a lower individual electrode 14*b* composed of a high-melting point metal such as Mo are formed on the stress-resistant layer 13 except the top portion of the protruding portion 11*a*. A plurality of heater elements 15 composed of $Ta_2N$ or Ta-$SiO_2$ are formed on the lower common electrode 14*a* and individual electrode 14*b* including the top portion of the protruding portion 11*a*. An upper common electrode 16*a* to be connected to the heater elements 15 is formed on one side of the heater elements 15, and an upper individual electrode 16*b* is formed on the other side of the heater elements 15, respectively. Each of the heater elements 15 between the lower common electrode 14*a* and the lower individual electrode 14*b* constitutes a heating portion 15A which is not covered with the upper common electrode 16*a* and the upper individual electrode 16*b*. Furthermore, a protective layer 17 having a thickness of about 5–10 μm is formed on the top surfaces of the heat accumulating layer 12, the heating elements 15 and the upper electrodes 16*a* and 16*b* so as to cover the entire surfaces of each of the electrodes 14*a*, 14*b*, 16*a* and 16*b* except the terminal portions thereof. The protective layer 17 consists of an oxidation-resistant layer 18 having a thickness of about 2 μm comprising $SiO_2$ and the like which protects the heater elements 15 from deterioration due to oxidation, and a wear resisting layer 19 having a thickness of about 3–8 μm comprising $Ta_2O_5$ and the like which protects the heater elements 15 and the upper electrodes 16*a* and 16*b* from contact with an ink ribbon, etc.

The operation and advantage of this embodiment will now be described.

The thermal head of this embodiment uses Si as a material of the substrate 11. The thermal conductivity of Si itself is about $340\times10^{-3}$ cal/cm.sec.°C. which is eight times higher than that of alumina (thermal conductivity: $40\times10^{-3}$ cal/cm.sec.°C.) used traditionally as a material for the substrate. Thus, the substrate 11 radiates sufficient heat even in case of a high-speed printing in which energizing cycle to the heater elements 15 is short, thereby reducing influence of the accumulation of heat on printing quality.

Any material may be suitably used for the substrate 11 so long as it has a high thermal conductivity. Particularly, Si and AlN are preferable.

In this embodiment, a compound including Si, at least one of the transition metals selected from Ta, W, Cr and M, and oxygen is used as a material for the heat accumulating layer 12. The thermal conductivity of the heat accumulating layer 12 composed of low thermal conductivity oxide can be reduced to about $2\times10^{-3}$ cal/cm.sec.°C., which is lower than that of a glass glaze and about 1/200 of the substrate 11 made of Si. Thus, excellent heat accumulating property can be obtained. The coefficient of thermal expansion of the heat accumulating layer 12 is about $3.5\times10^{-6}$/°C., which is approximately equal to that of the substrate 11 made of Si (about $3\times10^{-6}$/°C.). In addition, the hardness of the heat accumulating layer 12 is Hv 800 kg/mm$^2$ or less and the heat accumulating layer 12 includes SiOx ($0<x<2$) as a major ingredient. Thus, the heat accumulating layer 12 has excellent adhesiveness to the substrate 11 and can be stably manufactured.

If the heat accumulating layer 12 is formed into a columnar and black layer by sputtering an alloy target of Si and transition metal with about 0.8–1.6 of pressure in an oxygen atmosphere, the thermal conductivity and thermal capacity of the heat accumulating layer 12 can be reduced. Thus, a thermal head having high-speed heat responsivity which is suitable for the high-speed printing can be made.

The thus manufactured heat accumulating layer 12 can withstand at least a temperature of 1,000° C., it does not undergo a thermal deformation even when a peak temperature of the heater elements 15 increases to about 800° C. Therefore, a high-speed printing can be performed even in a low temperature environment where the peak temperature of the heater elements 15 is apt to increase.

By forming the stress-resistant layer 13 on the heat accumulating layer 12 with a high-modulus (at least about $3\times10^4$ kg/mm$^2$) insulating ceramic such as $Al_2O_3$, AlN and SiC to have a thickness of about 0.1–1.0 μm by vapor deposition, etc., durability against stresses to be applied to the heat accumulating layer 12, for example, a thermal stress upon contraction of a solder plating of outer connecting terminals and a shearing stress due to the friction between a platen and a thermal head when the thermal head is mounted on a printer to perform printing can be improved. Furthermore, by employing $Al_2O_3$, AlN and SiC for the stress-resistant layer 13, the layer has resistance to etching against a dry etching gas $CF_4$+$O_2$ when forming the lower electrodes 14 and the heater elements 15, thereby increasing formation accuracy of the heater elements and the life thereof when mounted on the printer to perform printing. Even if a glass glaze having a small expansion coefficient and a low thermal stress is employed as in a conventional manner, durability against the thermal stress upon contraction of a solder plating and the shearing stress when printing, and resistance to etching at the time of pattern formation can be increased by forming the stress-resistant layer 13 on the heat accumulating layer 12.

The electrodes according to the present invention are configured into a double-layer electrodes including the lower electrodes 14 and the upper electrodes 16. By arranging the heater elements 15 between the lower electrodes 14 and the upper electrodes 16, the lower electrodes 14 having a thickness of about 0.1 μm composed of a high-melting point metal such as Mo or the like can be obtained. Thus, a pattern for the lower electrodes 14 can be etched highly precisely. In addition, etching selectivity of the heater elements 15 to the lower electrodes becomes unnecessary, and the lower electrodes 14 and heater elements 15 can be formed precisely in the same etching device and etching gas such as $CF_4$+$O_2$.

Figure 2:
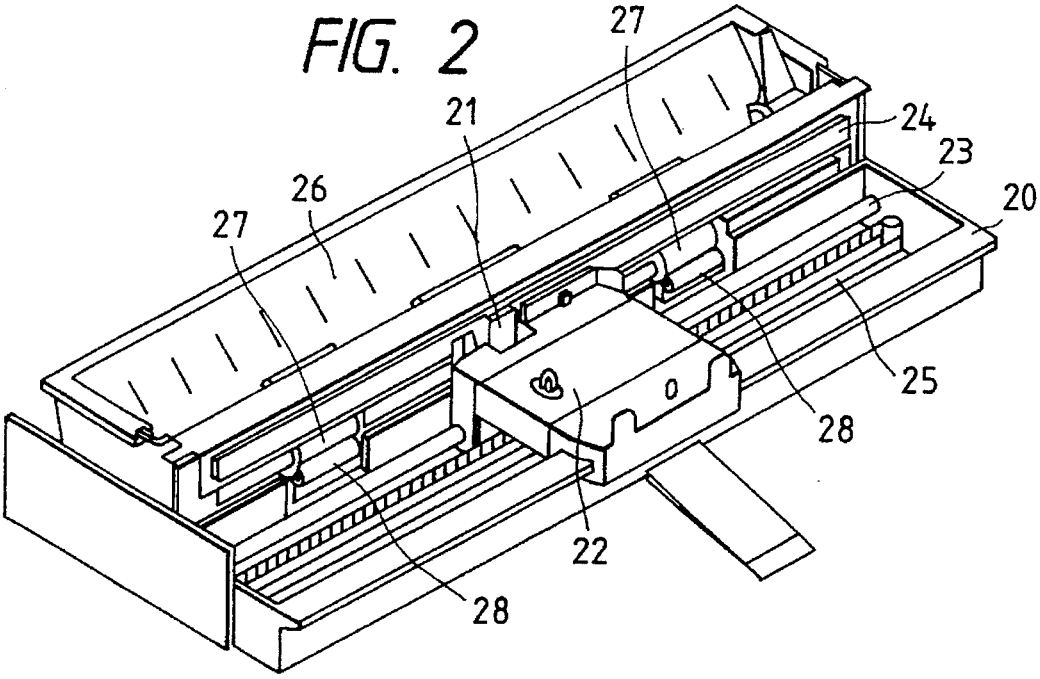
FIG. 2 is a perspective view showing a thermal printer equipped with the thermal head of FIG. 1.
Figure 3:
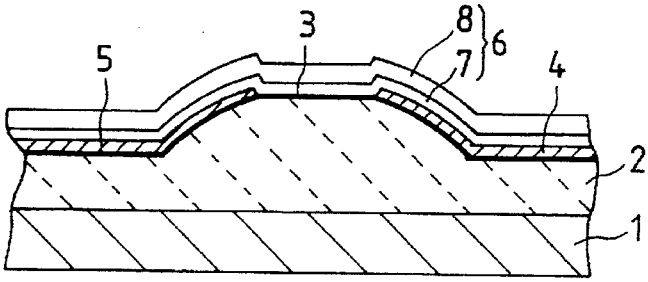
FIG. 3 PRIOR ART
FIG. 3 is a cross sectional view showing a configuration of a conventional thermal head.

The thermal head constituted as described above is mounted on a serial type thermal printer shown in FIG. 2 to conduct an actual printing test.

In the thermal printer shown in FIG. 2, a carriage 22 equipped with a thermal head 21 of this embodiment is provided so that it can reciprocate along a shaft 23. When a timing belt 25 is driven with the thermal head 21 pressed into contact with a platen 24 through an ink ribbon and a normal paper or a heat-sensitive paper, the carriage 22 reciprocates to perform a desired printing.

The paper is introduced into a printer through a paper guide portion 26, and sequentially fed to a printer by means of a paper feeding roller 27 and a small roller 28.

By the thermal head constructed as described above, actual printing was performed using a thermal head with resolution of 400 dpi at a printing speed of 100 cps. There caused no tailing, bleeding and margin stain, and extremely high quality printing result could be obtained.

As described above, according to the thermal head of this embodiment, a material having high thermal conductivity such as Si is used for the substrate 11 and a compound including Si, at least one element selected from transition metals and oxygen is used for the heat accumulating layer 12. This offers the following advantages. Heat radiation property of the substrate 11 itself remarkably increases and a problem of heat accumulation does not arise even if a high-speed printing in which energizing cycle to the heater elements 15 becomes short is performed. When the thermal head is of a high resolution, optimum balance between heat accumulation and heat radiation can be obtained and it is possible to perform a high-quality printing at high speed.

Furthermore, by providing the stress-resistant layer 13 for reinforcing the heat accumulating layer 12 and arranging the heater elements 15 between the upper and lower electrodes 14 and 16, it is possible to perform high-quality printing with a long life.

The present invention is not limited to the embodiment as described above, and various modifications may be made therein as needed. For example, in the embodiment as described above, there is described that the heat accumulating layer 12 is formed on the entire surface of the substrate 11 inclusive of the top surface of the protruding portion 11*a* of the substrate 11. However, it is needless to say that the heat accumulating layer 12 may be formed only on the top surface of the protruding portion 11*a*. In addition, the thermal head may be constructed so that the heat accumulating layer 12 is directly formed on the surface of the substrate 11 without forming the protruding portion 11*a*.

As has been described above, according to the thermal head of the present invention, a material having high thermal conductivity such as Si is used for the substrate 11 and a compound including Si, at least one element selected from transition metals and oxygen is used for the heat accumulating layer 12. This offers the following advantages. Heat radiation property of the substrate 11 itself remarkably increases and a problem of heat accumulation does not arise even if a high-speed printing in which energizing cycle to the heater elements 15 becomes short is performed. When the thermal head is of a high resolution, optimum balance between heat accumulation and heat radiation can be obtained and it is possible to perform a high-quality printing at high speed.

Furthermore, by providing the stress-resistant layer for reinforcing the heat accumulating layer 12, durability against stresses to be applied to the heat accumulating layer, for example, a stress of a solder plating of outer connecting terminals and a shearing stress due to the friction between a platen and the thermal head when the thermal head is mounted on a printer to perform printing can be improved, and it is possible to perform a high-quality printing with a long life.

What is claimed is:

1. A thermal head comprising:

a high thermal conductivity substrate consisting essentially of silicon (Si);

a heat accumulating layer formed over said substrate, wherein said heat accumulating layer is composed of a compound including Si, at least one transition metal, and oxygen, and wherein said heat accumulating layer is formed into a columnar black layer;

a plurality of heater elements formed over said heat accumulating layer in line;

a common electrode and an individual electrode energizing each of said heater elements;

a plurality of outer connecting terminals contacting the common electrode and the individual electrodes; and a protective layer formed over said accumulating layer, said heater elements and said electrodes;

wherein a stress-resistant layer composed of an insulating high-modulus ceramic is provided over said heat accumulating layer, and a portion of said stress-resistant layer is interposed between said heat accumulating layer and at least one of said outer connecting terminals.

2. A thermal head according to claim 1, wherein said stress-resistant layer comprises AlN.

3. The thermal head according to claim 1, wherein said stress-resistant layer comprises $Al_2O_3$.

4. A thermal head comprising:

a high heat conduction substrate consisting essentially of silicon (Si);

a heat accumulative layer formed as a columnar black film over the substrate using vapor deposition, said heat accumulative layer including Si, at least one transition metal, and oxygen;

an anti-stress layer formed over the heat accumulative layer, wherein said anti-stress layer comprises a high modulus ceramic;

a plurality of heat generating elements formed in rows over the anti-stress layer;

a common electrode formed on the plurality of heat generating elements;

a plurality of individual electrodes, each individual electrode formed on an associated one of the plurality of heat generating elements;

a plurality of outer connecting terminals contacting the common electrode and the individual electrodes; and a protective layer formed over the heat accumulative layer, the plurality of heat generating elements, the common electrode and the plurality of individual electrodes, wherein a portion of said anti-stress layer is interposed between said heat accumulative layer and at least one of said outer connecting terminals.

5. The thermal head of claim 4, wherein the heat accumulating layer includes at least one of Ta, W, Cr, and Mo.

6. The thermal head of claim 4, wherein the high-modulus ceramic includes AlN.

7. The thermal head of claim 4, wherein the heat generating elements are selected from $Ta_2N$ and Ta-$SiO_2$.

8. The thermal head of claim 4, wherein the high-modulus ceramic includes $Al_2O_3$.

9. The thermal head of claim 4, wherein the high-modulus ceramic includes SiC.

* * * * *